US009941043B2

(12) United States Patent
Findeisen

(10) Patent No.: US 9,941,043 B2
(45) Date of Patent: Apr. 10, 2018

(54) CORE FOR AN ELECTRICAL INDUCTION DEVICE

(71) Applicant: SIEMENS AKTIENGESELLSCHAFT, Munich (DE)

(72) Inventor: Joerg Findeisen, Dresden (DE)

(73) Assignee: Siemens Aktiengesellschaft, Munich (DE)

( * ) Notice: Subject to any disclaimer, the term of this patent is extended or adjusted under 35 U.S.C. 154(b) by 0 days.

(21) Appl. No.: 15/326,886

(22) PCT Filed: Jul. 1, 2015

(86) PCT No.: PCT/EP2015/065002
§ 371 (c)(1),
(2) Date: Jan. 17, 2017

(87) PCT Pub. No.: WO2016/008727
PCT Pub. Date: Jan. 21, 2016

(65) Prior Publication Data

US 2017/0213631 A1 Jul. 27, 2017

(30) Foreign Application Priority Data

Jul. 16, 2014 (EP) ..... 14177246

(51) Int. Cl.
*H01F 27/24* (2006.01)
*H01F 27/08* (2006.01)
(Continued)

(52) U.S. Cl.
CPC ..... *H01F 27/08* (2013.01); *H01F 3/02* (2013.01); *H01F 17/06* (2013.01); *H01F 27/24* (2013.01)

(58) Field of Classification Search
CPC ..... H01F 27/00–27/36
(Continued)

(56) References Cited

U.S. PATENT DOCUMENTS 2,991,437 A 7/1961 Kreuzer et al.
3,157,850 A * 11/1964 Winter ..... H01F 27/245 336/215
(Continued)

FOREIGN PATENT DOCUMENTS

DE 3505120 C1 10/1986
EP 2474985 A1 7/2012
(Continued)

*Primary Examiner* — Tuyen Nguyen
(74) *Attorney, Agent, or Firm* — Laurence Greenberg; Werner Stemer; Ralph Locher

(57) ABSTRACT

A core for an electrical induction device has a plurality of lamination stacks which are each formed by laminated sheets. The lamination stacks lie on top of each other parallel to the layer plane of the laminated sheets. At least one of the lamination stacks is segmented and has at least two partial lamination stacks, the two partial lamination stacks respectively lying opposite each other with their stack end faces standing transverse, in particular perpendicular, to the layer plane of the laminated sheets. The stack end faces of the two partial lamination stacks have a spacing between each other through which a gap is formed extending between the two partial lamination stacks perpendicular to the layer plane. The gap forms a cooling channel or at least a section of a cooling channel, the channel longitudinal extension thereof extending transversely, in particular, perpendicular to the layer plane of the laminated sheets.

18 Claims, 12 Drawing Sheets

(51) Int. Cl.
*H01F 3/02* (2006.01)
*H01F 17/06* (2006.01)

(58) Field of Classification Search
USPC ..... 336/83, 178, 212, 233–234
See application file for complete search history.

(56) References Cited

U.S. PATENT DOCUMENTS 3,183,461 A * 5/1965 Tipton ..... H01F 27/245
336/212
3,967,226 A * 6/1976 Bennon ..... H01F 27/365
336/84 R
9,041,503 B2 5/2015 Mikoshiba et al.

FOREIGN PATENT DOCUMENTS

| | | | |
|---|---|---|---|
| EP | 2704161 | A1 | 3/2014 |
| FR | 573664 | A | 6/1924 |
| GB | 830688 | A | 3/1960 |
| JP | 2012138469 | A | 7/2012 |

* cited by examiner

CORE FOR AN ELECTRICAL INDUCTION DEVICE

BACKGROUND OF THE INVENTION

FIELD OF THE INVENTION

The invention relates to a core of an electrical induction device, preferably of a transformer or an inductor.

Cores known from the prior art are cores which are layered in a laminar manner from laminations (also called magnetic laminations or core laminations), said cores also being called stacked cores. Cores of this kind can be formed by cutting laminations of different width to size, in a stepped manner for each individual lamination stack. Cores (also called strip cores) in which the lamination is wound up in the manner of a coil largely without interruption are also known.

The material used for the laminations is predominantly grain-oriented, cold-rolled sheet metal which has a preferred magnetic direction in the rolling direction. The heat which is produced by the no-load losses is dissipated along and transverse to the layer plane to different extents in relation to the surface owing to the layering of the core from these grain-oriented metal sheets. This can be seen in a thermal conductivity which usually differs by a factor of 6 . . . 7.

At present, cooling channels are inserted parallel to the layer plane in the transformer structure since said cooling channels can be usually formed by inserting bars or spacers (for example ceramic disks). One disadvantage of forming cooling channels in this way is that the arrangement of the cooling channels cannot make use of the favorable conduction of heat parallel to the layer direction of the metal sheets.

Special external cooling surfaces for cooling cores are also known; these are described, for example, in German patent specification DE 35 05 120.

In order to further reduce the no-like losses, amorphous core materials are increasingly being used in distributor transformers nowadays. The prior art in respect of the use of amorphous core material is described, for example, in European laid-open specification EP 2 474 985 and Japanese laid-open specification JP 2010 289 858.

However, owing to the high material costs for amorphous core materials, the difficulty in processing and the limited design options, amorphous materials have not yet been able to gain prevalence to date, particularly in the case relatively large power transformers.

SUMMARY OF THE INVENTION

The invention is based on the object of specifying a core for an electrical induction device, which core ensures better heat dissipation than previous cores.

According to the invention, this object is achieved by a core having the features as claimed. Advantageous refinements of the core according to the invention are specified in dependent claims.

Accordingly, the invention provides that at least one of the lamination stacks is segmented and has at least two partial lamination stacks, the two partial lamination stacks lie opposite one another in each case by way of their lamination end sides which are transverse, in particular perpendicular, to the layer plane of the laminated sheets, the lamination end sides of the two partial lamination stacks are at a distance from one another, a gap, which extends perpendicular to the layer plane, between the two partial lamination stacks being formed by said distance, and the gap forms a cooling channel or at least a section of a cooling channel, the longitudinal direction of said cooling channel extending transverse, in particular perpendicular, to the layer plane of the laminated sheets.

A substantial advantage of the core according to the invention is that the good thermal longitudinal conductivity of the laminations is utilized for cooling the core owing to the described arrangement of the cooling channel or cooling channels transverse to the layer plane of the laminations. This advantageously leads to the possibility of achieving a reduction in the amount of space required for cooling and an increase in the filling factor for the core limb.

A further substantial advantage of the core according to the invention can be considered that of the described formation of the core from partial lamination stacks being suitable both for cores which are composed of layers of individual laminations and for cores which are wound from magnetic strips.

The width of the lamination stacks is preferably different, so as to form steps between lamination stacks which lie one on the other.

It is advantageous when the cross section of the core is matched to a circular cross section at least in sections owing to the formation of steps.

The number of different lamination widths in the partial lamination stacks is preferably at most one third of the number of steps. The number of different lamination widths in the partial lamination stacks is particularly preferably at most three.

The lamination widths in the partial lamination stacks are preferably identical.

It is also considered to be advantageous when at least two lamination stacks which are situated one on the other have an identical number of partial lamination stacks of identical width, but are nevertheless of different width, wherein, in the case of the relatively wide lamination stack, at least two partial lamination stacks are separated from one another by the or one of the cooling channels.

A particularly preferred refinement provides that the core, as viewed from the inside to the outside, alternately has a lamination stack of the first kind and a lamination stack of the second kind, wherein, in the case of a lamination stack of the first kind, at least two partial lamination stacks, preferably all of the partial lamination stacks, are separated from one another by a gap or cooling channel, and wherein, in the case of a lamination stack of the second kind, at least two partial lamination stacks, preferably all of the partial lamination stacks, lie one on the other without a gap.

At least two lamination stacks of the first and second kind which lie one on the other preferably have the same number of partial lamination stacks of identical width.

It is also advantageous when the laminations are formed by a thin-walled strip material, preferably an amorphous strip material, and the lamination stacks are each wound from this strip material.

For further cooling, there is preferably additionally at least one cooling channel, the longitudinal direction of said cooling channel extending parallel to the layer plane of the laminated sheets.

A further preferred refinement provides that the lamination stacks are bent in sections, wherein the bending radii of at least two lamination stacks which lie one on the other are selected in such a way that a hollow space, preferably in the form of an arcuate gap, is formed in the bending region between these lamination stacks, wherein the hollow space is connected to one of the cooling channels or all of the cooling channels and makes it possible for a coolant to be fed into the cooling channel or cooling channels through the hollow space.

The width of the widest partial lamination stack is preferably an integer multiple of the narrowest partial lamination stack.

Tensioning belts are preferably used for mechanical stabilization. Accordingly, in the case of a further preferred refinement of the cores, it is provided that the wound partial lamination stacks are stabilized and fixed by means of tensioning belts, wherein the tensioning belts are arranged on the lamination stacks in such a way that the position of said tensioning belts is respectively offset in relation to the tensioning belt of the adjacent partial lamination stack and said tensioning belts are designed in such a way that a cooling channel is formed in the space between the partial lamination stacks. For cost reasons, tensioning belts which are composed of a non-magnetic metal material are preferably used.

When the core is used in inductors, air gap inserts can be provided, said air gap inserts being adhesively bonded to the core material.

The above-described stepped arrangement of the core is particularly advantageous in the case of cores which are composed of amorphous or nanocrystalline strip material since it makes the use of round short-circuit-proof windings possible.

In order to control the radial winding forces, which occur in the case of a short circuit, in a simple manner, windings with circular coils which are fitted onto the limbs of the core are preferably preferred for transformers and inductors.

In order to achieve a high filling factor (optimum filling of the circular cross section of the winding with magnetic material) for the core limb, the cross section of the limb preferably has multiple steps.

A further advantageous embodiment of the core provides the formation of core steps from the lamination stacks and therefore approximation to the circular shape of the winding when core laminations of only one or a few lamination widths are used. At the same time, the formation of effective and space-saving cooling channels is made possible.

As can be gathered from the above explanations, the preferred core designs are also suitable for cores of electrical induction devices which operate in the high-frequency range since the advantages indicated above preferably come to the fore on account of the frequency dependency of the remagnetization losses in the case of said core designs and the use provides economic advantages even in the case of relatively low powers.

In a preferred embodiment, the bending radii of the wound partial lamination stacks of an assembled core are each selected in such a way that a gap for circulation of a cooling fluid is respectively formed in the bend between limb and yoke. In this case, the lower bend serves to receive the cooling fluid, which flows in transverse to the winding direction, is distributed within the bend among the cooling channels between the partial lamination stacks, in order to then rise due to the heating and exit again at the upper bend between limb and yoke.

The invention is explained in greater detail below with reference to preferred exemplary embodiments which are illustrated in greater detail in FIGS. 1 to 16.

For the sake of clarity, the same reference symbols are always used for identical or comparable components in the figures.

DESCRIPTION OF THE INVENTION

Figure 1:
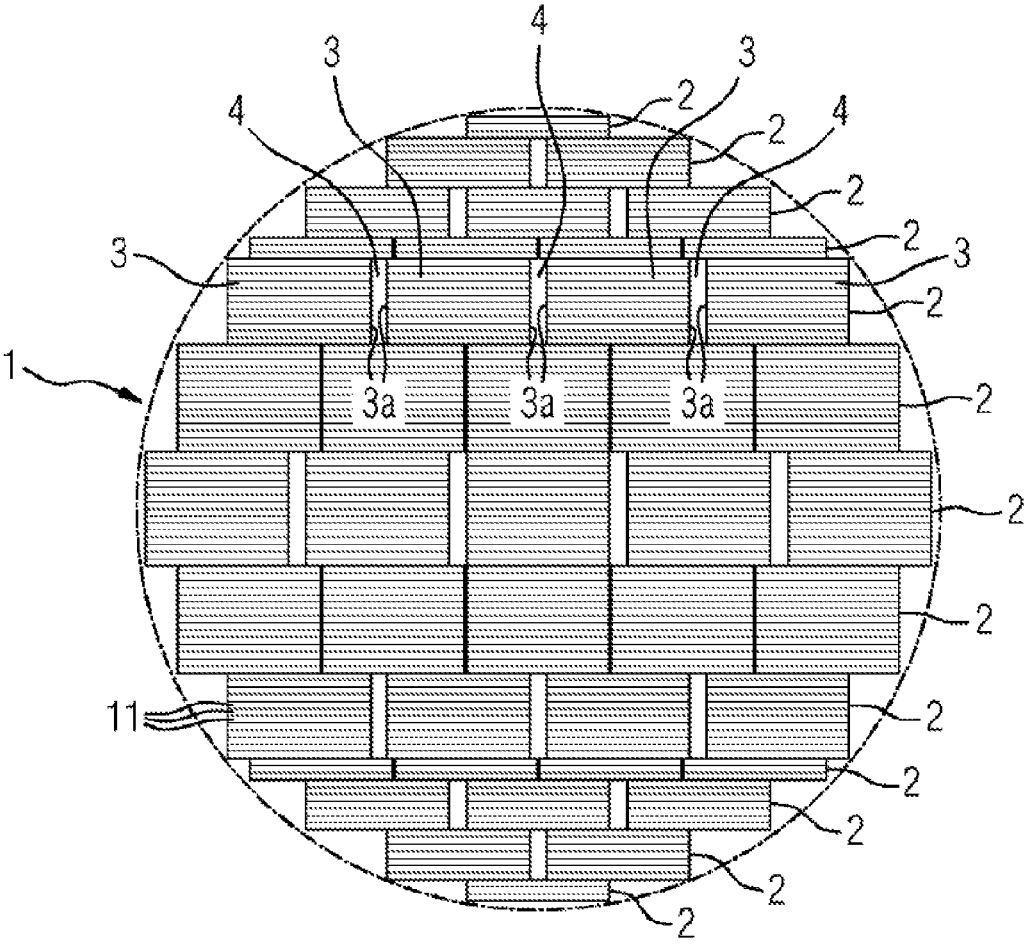
FIG. 1 is a sectional view of a core according to the invention.

FIG. 1 shows an exemplary embodiment of a core 1 for an electromagnetic induction device, not illustrated any further. The core 1 consists of a plurality of lamination stacks 2 which are each formed by laminated sheets 11 which are composed of magnetizable material, wherein the lamination stacks lie one on the other parallel to the layer plane of the laminated sheets 11.

In the exemplary embodiment, at least some of the lamination stacks 2 are segmented and have a plurality of partial lamination stacks 3. The partial lamination stacks 3 are at least partially arranged in relation to one another in such a way that a gap is formed at the joint between the lamination end sides 3*a* of the partial lamination stacks, said gap being dimensioned in such a way that it is possible for a coolant to flow and a cooling channel 4 is formed.

In the case of a lamination stack with a rectangular cross section, neutral planes with the maximum temperature are established, said planes each being perpendicular to the direction of the flow of heat under consideration and intersecting the stack axes. Starting from said neutral planes, the core temperature drops parabolically as far as the core surface, in order to there fall to the value of the oil temperature within the flow zone of the coolant. The thermal flow density at the core surface is largely dependent on the internal thermal resistance of the body. This is considerably lower in the layer plane than transverse to said layer plane. However, the losses are distributed largely uniformly over the lamination body. Therefore, particularly effective cooling can be achieved by the cooling channels 4 perpendicular to the layer plane. Owing to the resulting possible reduction in the cross-section requirement for the cooling channels 4, an increase in the filling factor of the iron core and therefore a reduction in the core cross section can be achieved.

The total width of the individual lamination stacks 2 is determined by the number of partial lamination stacks 3 in each case. The height of the lamination stacks 2 is established by the number of layered laminations 11. A stepped core is formed by appropriate selection of said parameters. In the exemplary embodiment according to FIG. 1, all of the core lamination stacks 2 are formed from core lamination strips or partial lamination stacks 3 of the same width.

In the exemplary embodiment according to FIG. 1, the partial lamination stacks 3 are each arranged alternately with or without a gap, that is to say with or without cooling channels between the partial lamination stacks 3. This results in a different total width of the lamination stacks 2 which form the steps of the core 1.

In the exemplary embodiment according to FIG. 1, each second lamination stack has cooling channels 4, so that the number of steps is once again doubled, without additional lamination widths being required. It is possible to achieve a substantial approximation of a core limb to a circular shape in this way. Therefore, it is possible to use round windings together with a high filling factor of the core at the same time, without the use of a large number of lamination widths.

Figure 2:
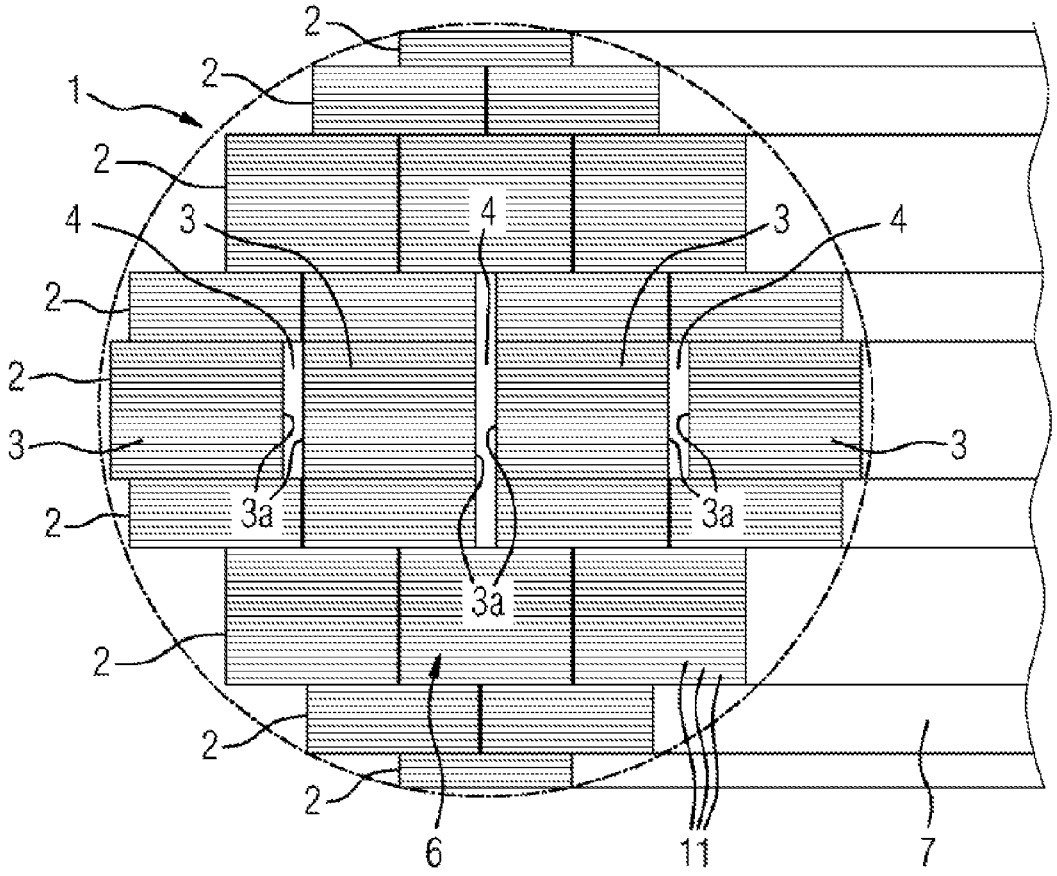
FIGS. 2-4 are sectional views of further exemplary embodiments of the core according to the invention.

FIG. 2 shows a plan view of the sectional illustration of a limb 6, which is composed of layers of magnetic laminations, of a further exemplary embodiment of a core 1.

The limb 6 and a yoke 7 which is connected to said limb are composed of stacks of individual laminations in the exemplary embodiment. The individual laminations form joints in the transition region between limb and yoke, said joints being offset in relation to one another in layers and forming a tenon and mortise joint.

The use of the high thermal longitudinal conductivity of the laminations 11 is possible owing to the illustrated segmentation of the lamination stacks 2 into partial lamination stacks 3 and the associated possible arrangement of the cooling channels 4 at the sectional edges of the lamination.

The illustrated arrangement of the cooling channels 4 along the sectional edges of the laminations 11 not only allows good thermal conductivity of the laminations 11 transverse to the layer plane to be utilized but further cooling channels can be inserted in a targeted manner into the regions of the core which are under high thermal loading.

In the exemplary embodiment according to FIG. 2, the lamination stack which forms the middle core step is provided with three cooling channels 4 and the second core step is provided with a single cooling channel 4. Cooling channels in the edge layers of the core 1 which are well cooled in any case can be dispensed with, and a further increase in the filling factor of the core 1 is possible.

Figure 3:
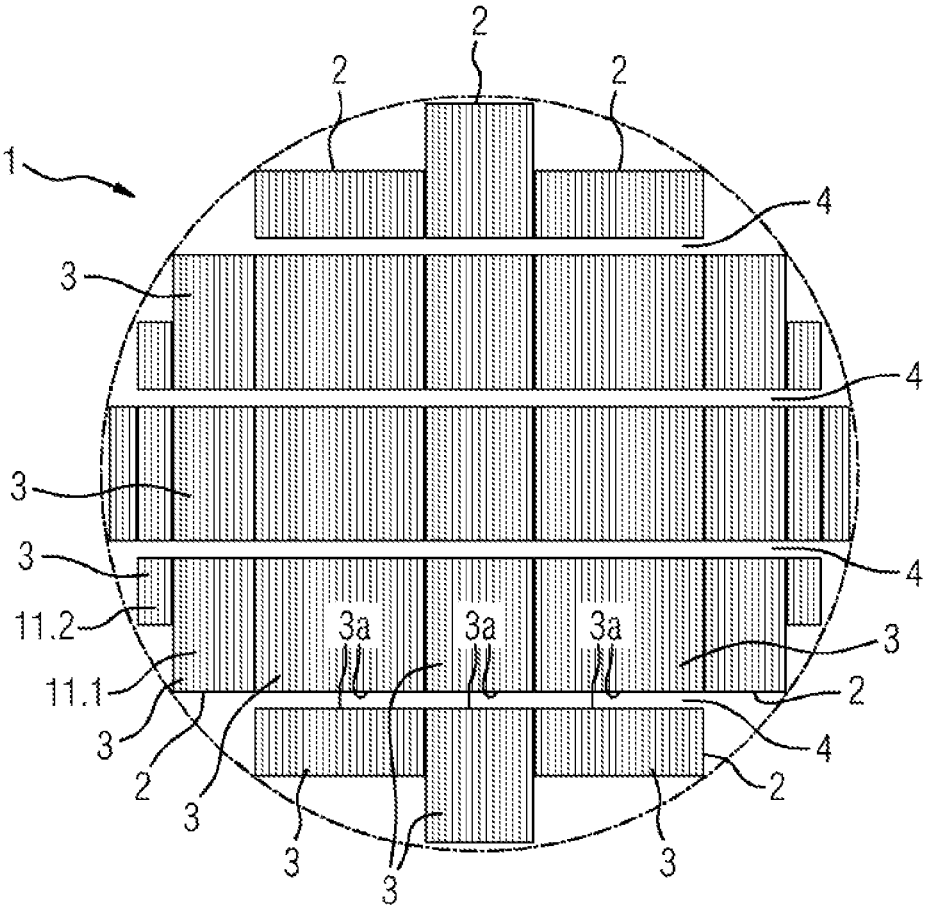

FIG. 3 shows a third exemplary embodiment in which a five-step core 1 is implemented using two different widths for the laminations 11.1 and 11.2 of the partial lamination stacks 3. As a result, a finely stepped core with a large number of steps can be formed with only two different lamination widths of the core material.

In the embodiment illustrated in FIG. 3, the width of the largest partial lamination stack 3 forms a multiple of the smallest width of a partial lamination stack. Owing to said formation of multiples of the width of the partial lamination stacks 3, the formation of connections between the cooling channels 4 of the lamination stacks which follow one another is simplified. In the exemplary embodiment according to FIG. 3, all of the steps are provided with cooling channels 4 owing to this design, said cooling channels being connected to one another in such a way that a cooling medium can flow transverse to the laminar layer direction of the laminations 11.1 and, respectively, 11.2.

Figure 4:
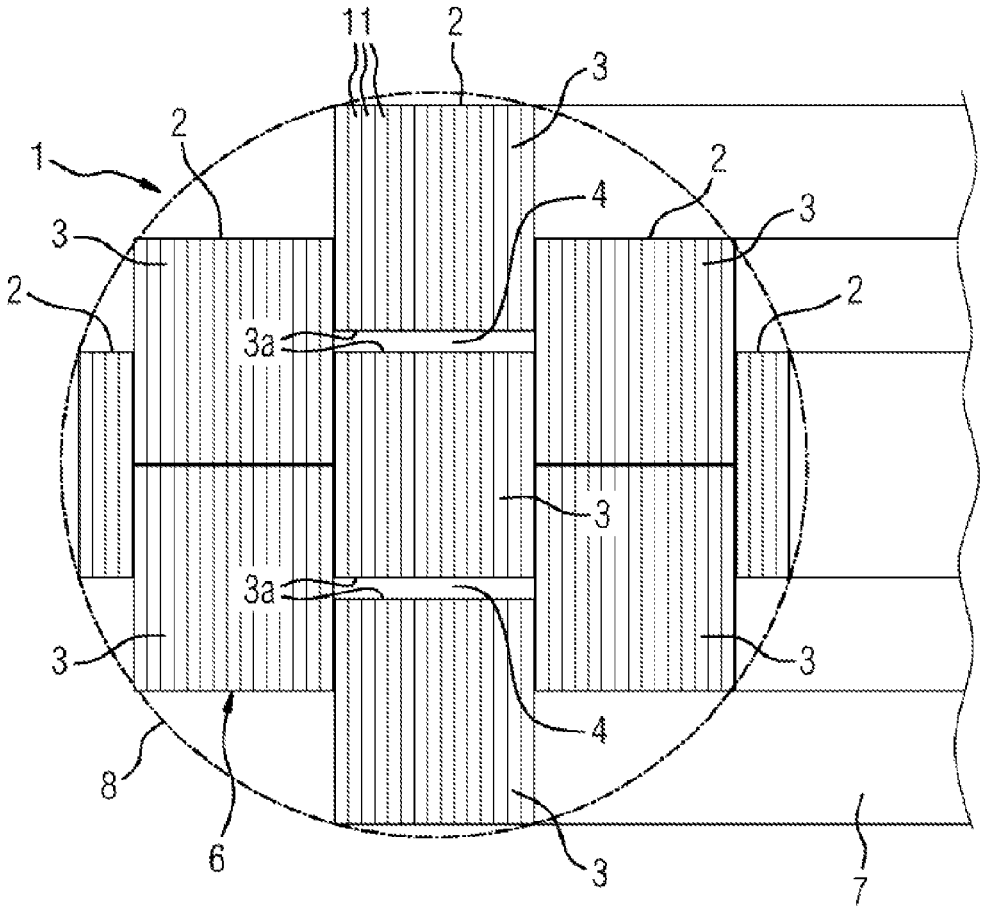

FIG. 4 shows a fourth exemplary embodiment; in this exemplary embodiment, the laminated sheets 11 of the lamination stacks 2 are formed by means of a wound strip material. This embodiment is suitable, for example, for laminations with a preferred magnetic direction since the lamination is applied in strip form and can be wound without interruption. In order to fit the electrical windings, the individual turns of the strip core are separated in an offset manner such that there is in each case only one tenon and mortise joint position in the magnetic circuit. This wound core design is particularly suitable for the use of strips which are composed of amorphous core material or strips which are composed of nanocrystalline metals.

The layering of the winding layers is shown in FIG. 4 by the sectional illustration of the limb 6. It can be seen that only strip material of one width is used here. The strip material is continuously wound, in a manner comprising two limbs 6 and the yokes 7 in each case. The assembly of the central lamination stacks which are each composed of a plurality of partial lamination stacks 3 produces a stepped core which is matched to the circular shape 8.

As can be seen, the lamination stacks, which form the central core step, are provided with cooling channels 4 which are each arranged transverse to the layer plane.

Figure 5:
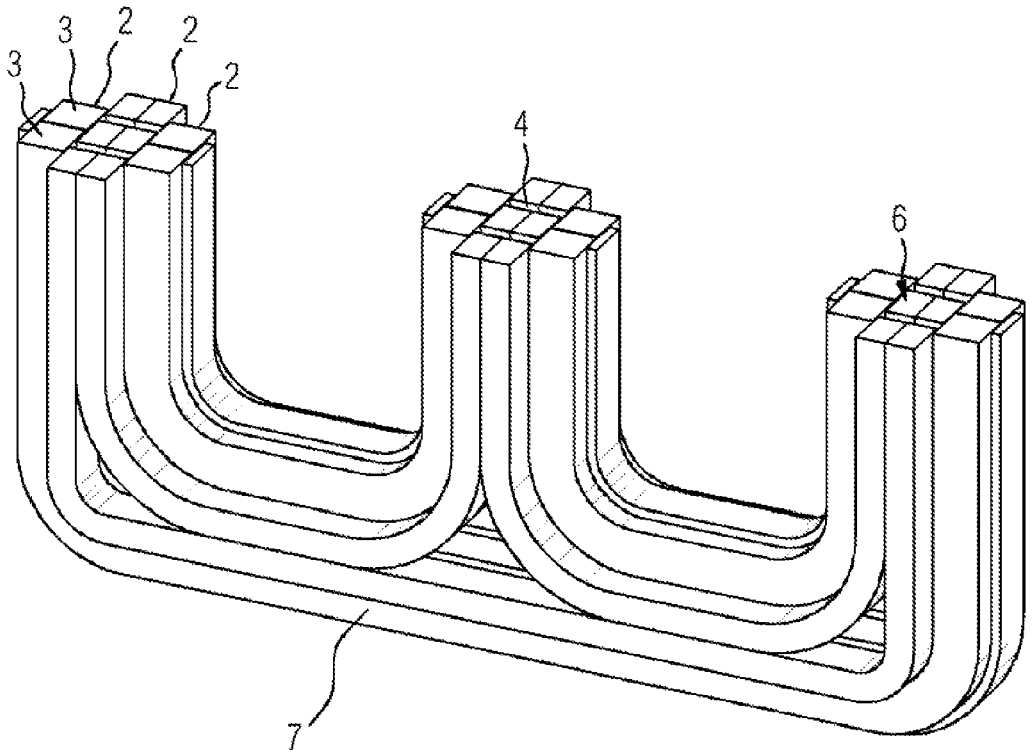
FIG. 5 is a partial perspective view of the core according to FIG. 4.

FIG. 5 shows a three-dimensional sectional illustration of the three-limb core according to FIG. 4 which is wound from strip material. The strip material is circumferentially wound so as to form the cooling channels—designed in the manner described above—in each case in partial lamination stacks 3 which each form corresponding limbs 6 and yoke sections 7. In the exemplary embodiment according to FIG. 5, the cooling channels 4 of the core limbs 6 are continued in the yokes 7 of the core.

Figure 6:
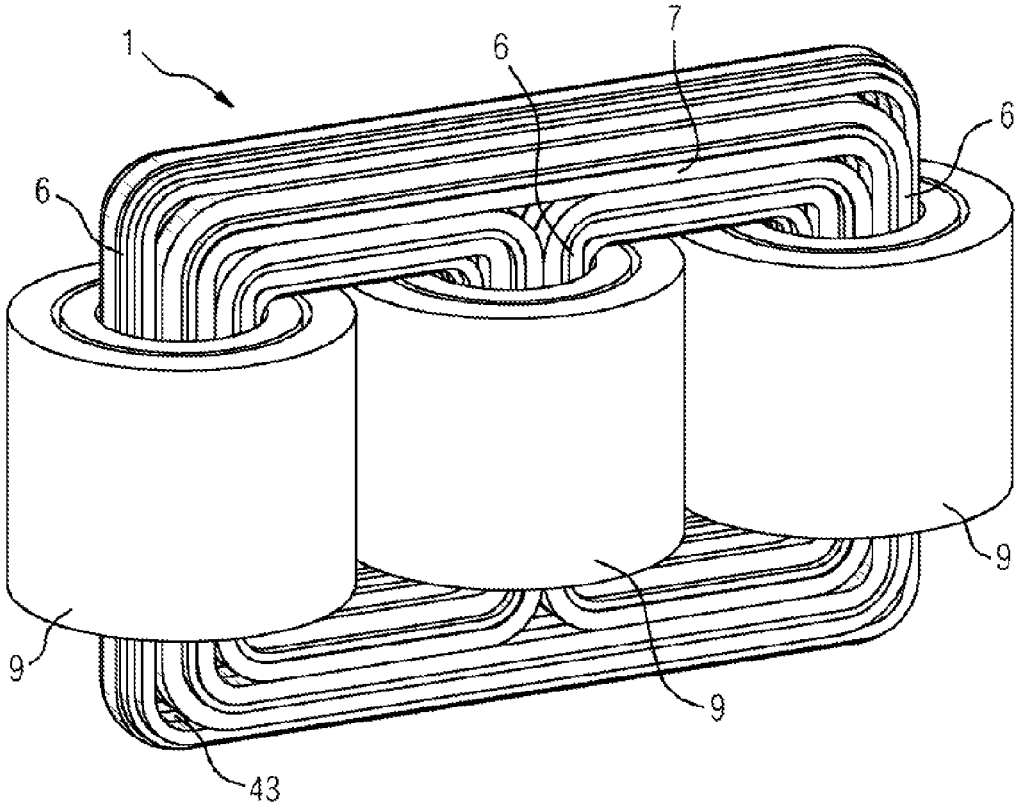
FIG. 6 is a perspective view of an active part of a three-phase transformer.

FIG. 6 shows a full view of an exemplary embodiment for the active part of a three-phase transformer which is equipped with a core 1 which is provided with cooling channels 43. In the exemplary embodiment, windings 9 of the three-phase transformer are arranged on the limbs 6. In the exemplary embodiment, the partial lamination stacks of the core 1 are formed from amorphous strip material.

Figure 7:
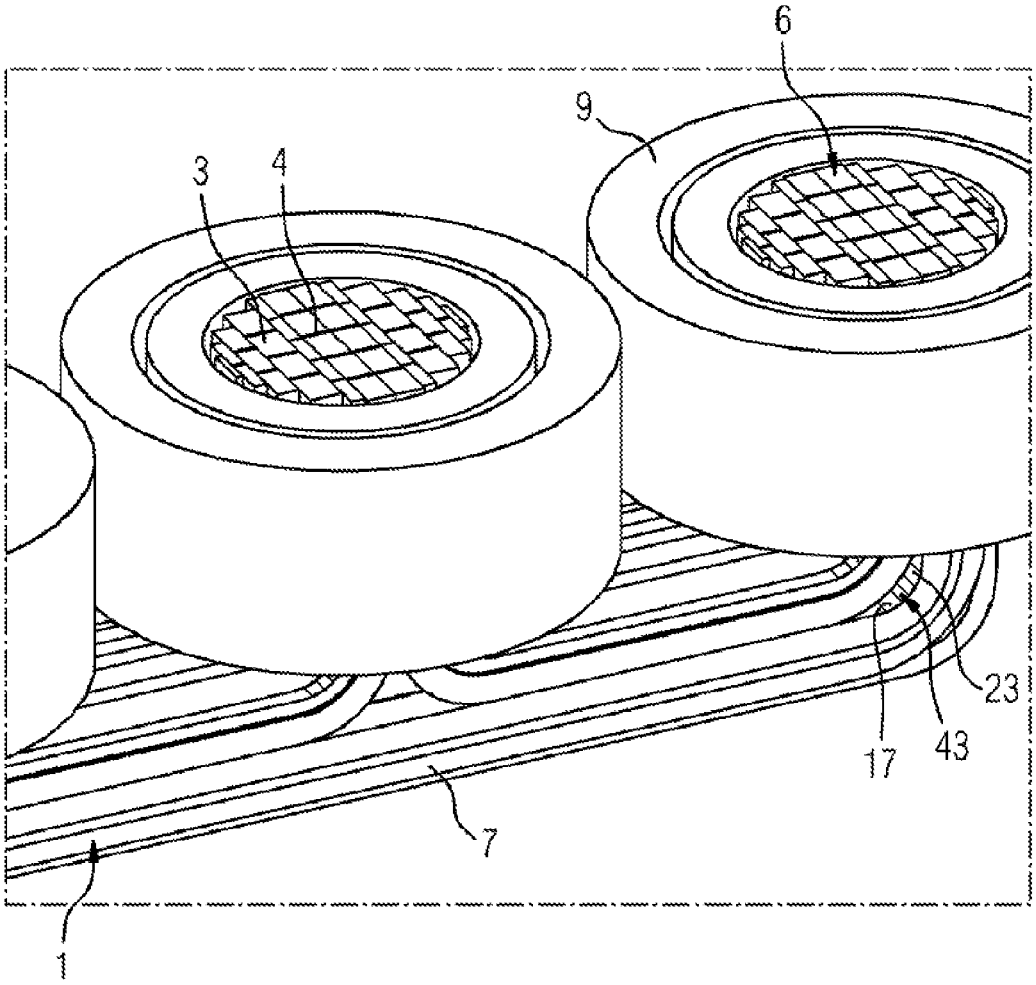
FIG. 7 is a partial section taken through the embodiment of FIG. 6.

FIG. 7 shows a sectional illustration of the exemplary embodiment shown in FIG. 6 in greater detail. In the exemplary embodiment, the bending radii 17 of the partial lamination stacks 3, which are arranged one on the other, of an assembled core 1 are each selected in such a way that an arcuate gap 23 and therefore a cooling channel 43 for circulation of a cooling fluid are respectively formed in the bend between limb 6 and yoke 7.

Figure 8:
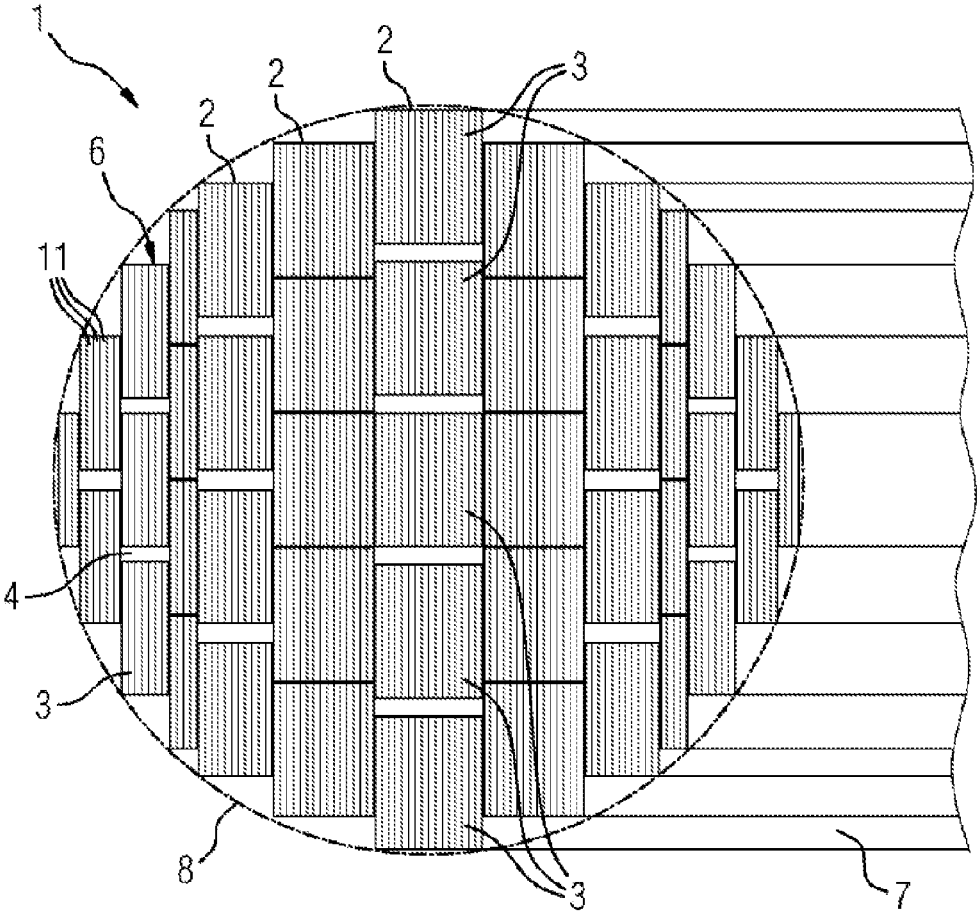
FIG. 8 is a section taken through a limb of a further exemplary embodiment of the invention.

FIG. 8 shows a section through the limb 6 of a further exemplary embodiment for a core 1, in which the partial lamination stacks 3 of the lamination stacks 2 are produced by means of a wound strip material. The seven-step core which is illustrated in the example uses only laminations 11 of a single strip width in order to form the steps.

A full view of the lower yoke 7 of the core 1 can be seen in the background. The strip material is continuously wound, in a manner comprising two limbs 6 and the yokes 7 in each case.

Figure 9:
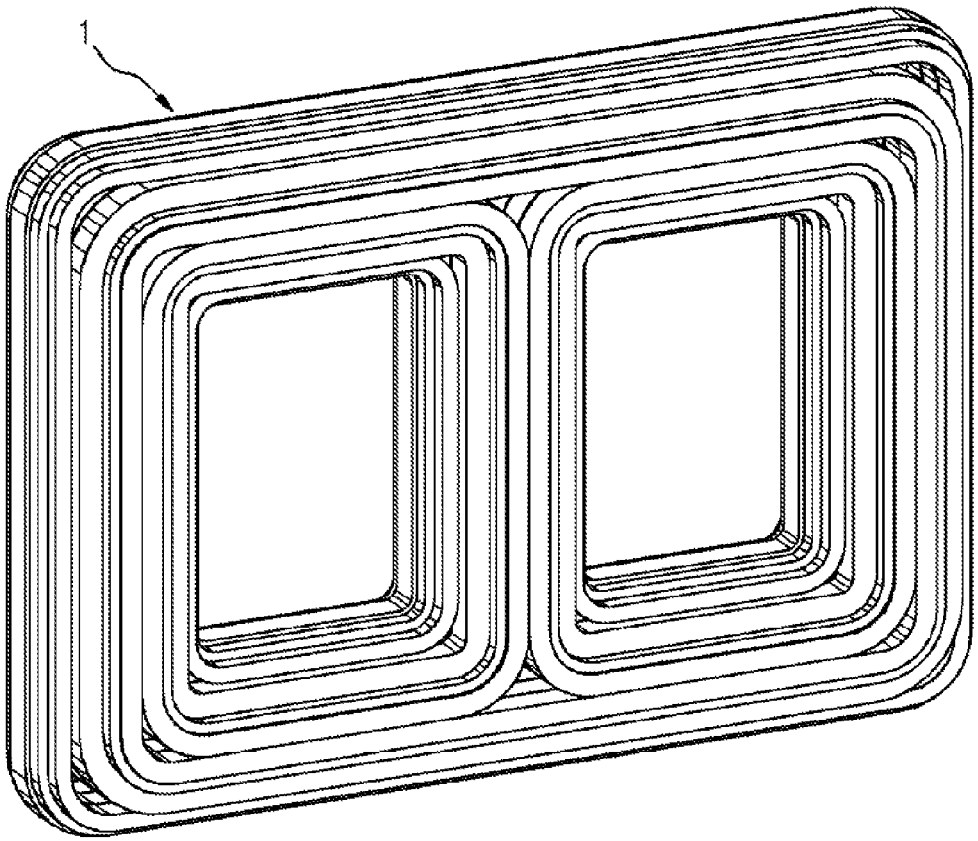
FIG. 9 is a perspective view of the embodiment of FIG. 8.

FIG. 9 shows a three-dimensional view of the core 1 according to FIG. 8 obliquely from the side.

Figure 10:
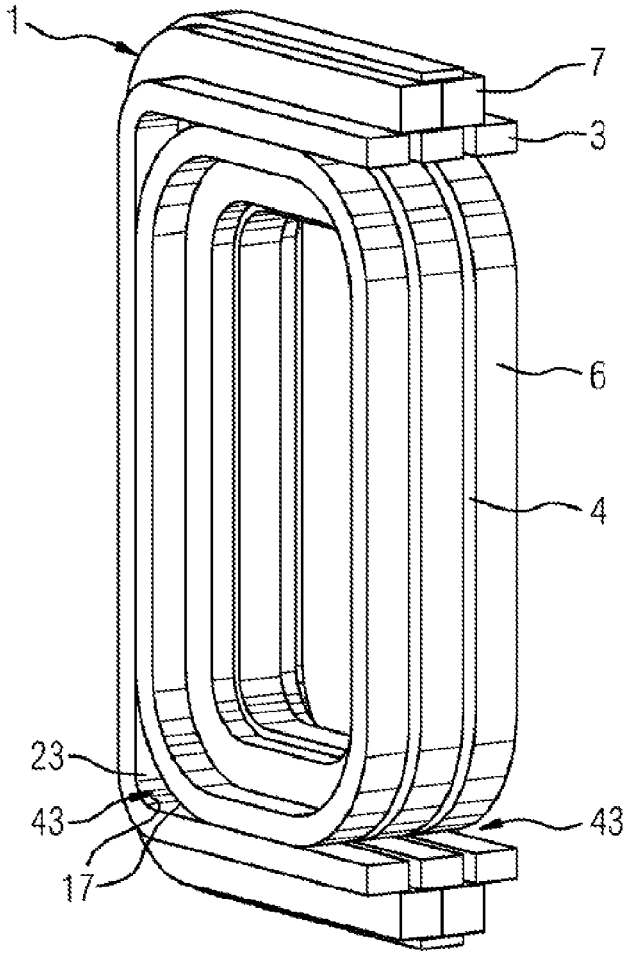
FIGS. 10 and 11 is partial perspective views thereof.

FIG. 10 shows a sectional illustration through the axis of the central limb of a further exemplary embodiment of a three-limb core parallel to the plane of the core strip. Vertical cooling channels 4 are arranged between the partial lamination stacks 3 of the limb 6.

In the exemplary embodiment according to FIG. 10, the winding radii 17 of the partial lamination stacks 3 of the core 1 are each selected in such a way that an arcuate gap 23 for forming a cooling channel 43 for circulation of the coolant is respectively formed in the bend between limb 6 and yoke 7. This arcuate gap 23 is connected to the cooling channels 4 between the partial lamination stacks 3. In this case, the lower bend serves to receive the coolant, which flows in transverse to the winding direction, is distributed within the bend among the cooling channels 43 between the strips, in order to then rise due to the heating and exit again at the upper bend between limb 6 and yoke 7.

Figure 11:
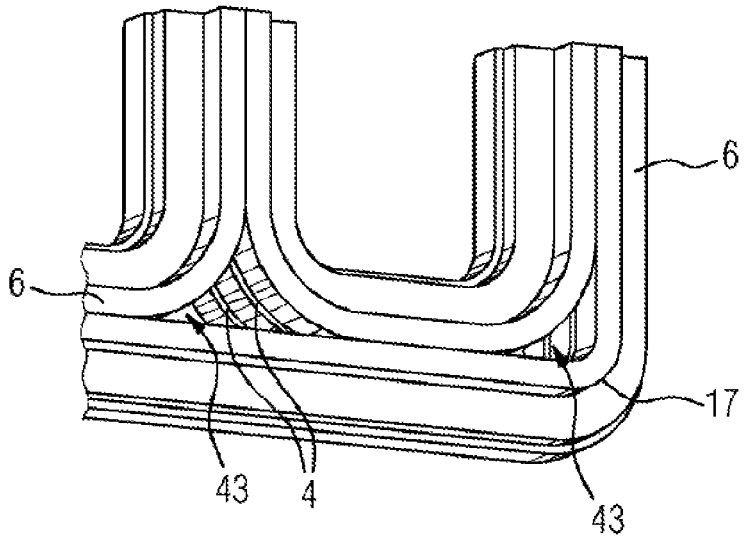

FIG. 11 shows a view of part of the limb/yoke transition of the exemplary embodiment described in FIG. 10 in greater detail.

Figure 12:
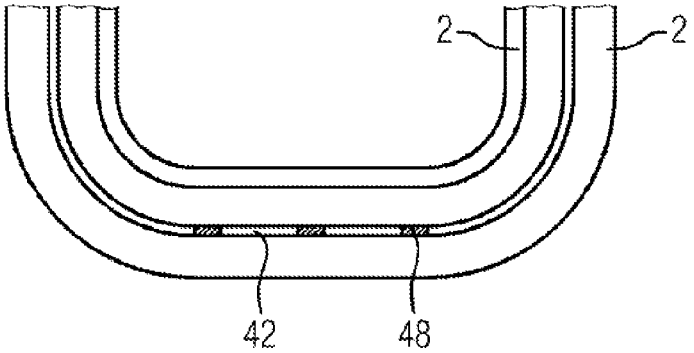
FIG. 12 is a partial elevation view thereof.

FIG. 12 shows the front view of an exemplary embodiment with a wound strip core which is composed of amorphous material, in which the lamination stacks 2 which are located radially one on the other are spaced apart in relation to one another by means of shims 48 in such a way that a cooling channel 42 for supplying the cooling channels (not visible) is formed between the partial lamination stacks which are arranged parallel to one another.

Figure 13:
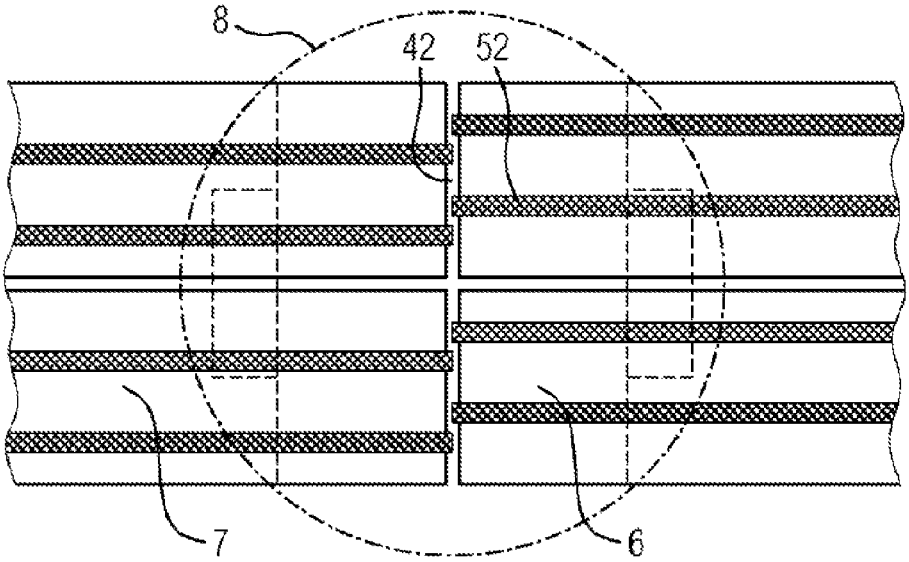
FIG. 13 is a partial view of a central limb of a three-phase transformer.

FIG. 13 shows an exemplary embodiment of the central limb 6 of a three-phase transformer with a plurality of partial lamination stacks which magnetically couple the central limb 6 to an adjacent limb. Radial cooling channels 42 can be seen between the partial lamination stacks in the region of the limb 6 which is connected to the yoke 7. Tensioning belts 52 which surround the partial lamination stacks over the circumference are used for mechanical stabilization. Said tensioning belts can be arranged both transverse and also longitudinally to the winding direction. In the exemplary embodiment according to FIG. 13, the arrangement is longitudinal, that is to say parallel to the winding direction.

The tensioning belts 52 are positioned on the partial lamination stacks in the transverse direction preferably in such a way that the position of said tensioning belts is respectively offset in relation to the tensioning belt of the adjacent partial lamination stack and the space between the partial lamination stacks forms a cooling channel.

Figure 14:
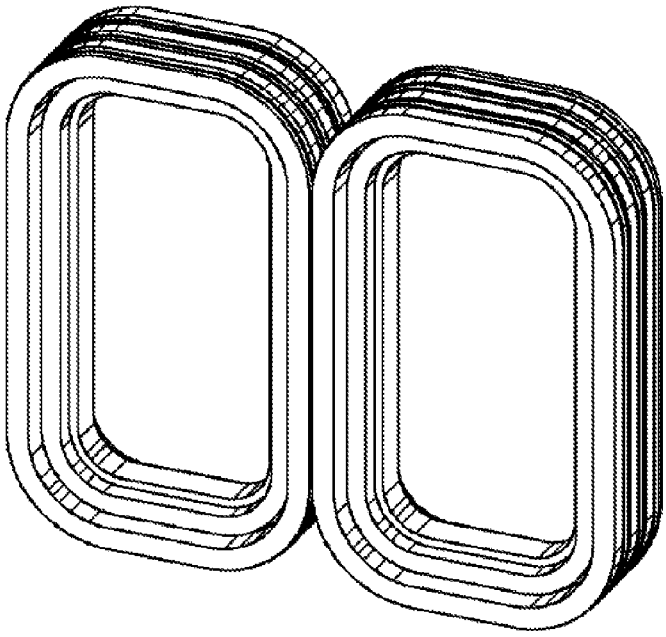
FIG. 14 is a perspective view of the core according to FIG. 13.

FIG. 14 shows a three-dimensional view of the three-limb core according to FIG. 13.

Figure 15:
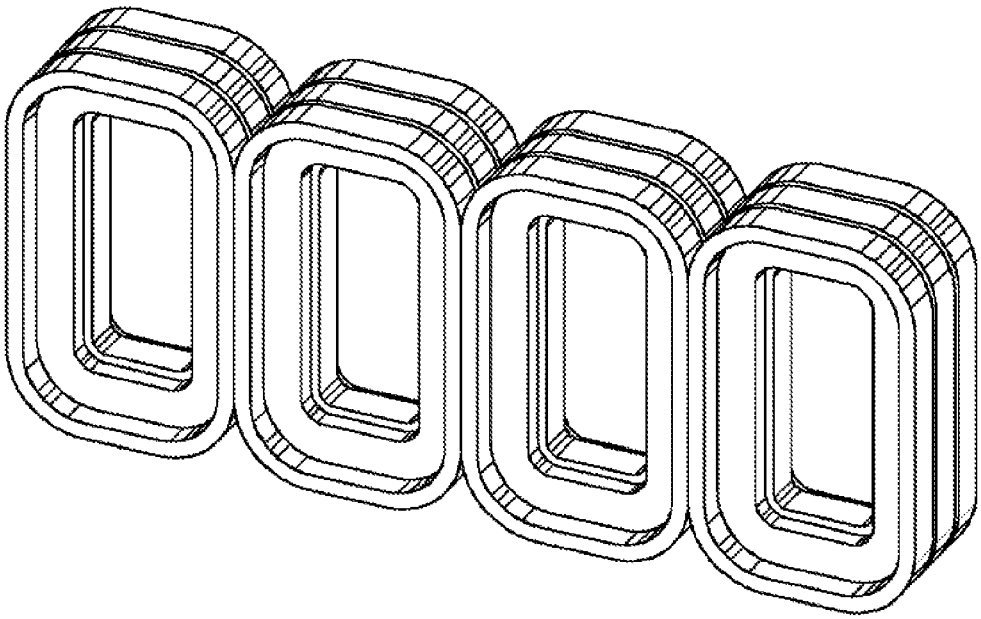
FIGS. 15 and 16 are perspective views of an exemplary embodiment of a five-limb core according to the invention.
Figure 16:
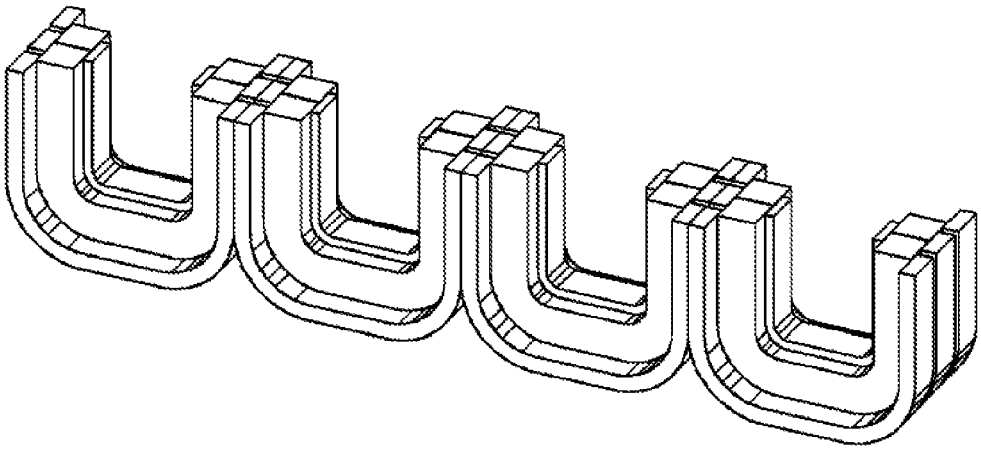

FIGS. 15 and 16 show an exemplary embodiment of a five-limb core. In this case, the core is preferably formed from wound partial lamination stacks of a strip material.

The three inner limbs are provided for mounting windings, while the outer limbs serve as return limbs. In this case too, the cores are formed from wound segments which are preferably composed of amorphous strip material.

The invention claimed is:

1. A core for an electrical induction device, the core comprising:

a multiplicity of lamination stacks each formed of laminated sheets, said lamination stacks lying one on the other parallel to a layer plane of said laminated sheets;

at least one of said lamination stacks being segmented and having at least two partial lamination stacks;

said two partial lamination stacks lying opposite one another with facing lamination end sides that are transverse to the layer plane of said laminated sheets, the lamination end sides of said two partial lamination stacks having a spacing distance therebetween, forming a gap between said two partial lamination stacks that extends perpendicular to the layer plane of said laminated sheets; and said gap forming a cooling channel, or at least a section of a cooling channel, with a longitudinal direction thereof extending transversely to the layer plane of said laminated sheets.

2. The core according to claim 1, wherein:

said lamination end sides of said two partial lamination stacks are perpendicular to the layer plane of said laminated sheets; and said cooling channel has a longitudinal direction extending perpendicularly to the layer plane of said laminated sheets.

3. The core according to claim 1, wherein a width of said lamination stacks is different between certain said lamination stacks, so as to form steps between lamination stacks which lie on one another.

4. The core according to claim 3, wherein a cross section of the core is matched to a circular cross section at least in sections owing to a formation of said steps.

5. The core according to claim 1, wherein a number of different lamination widths in said partial lamination stacks is at most one third of a number of steps.

6. The core according to claim 1, wherein a number of different lamination widths in said partial lamination stacks is at most three.

7. The core according to claim 1, wherein lamination widths in said partial lamination stacks are identical.

8. The core according to claim 1, wherein:

at least two lamination stacks which are disposed on one another have an identical number of partial lamination stacks of identical width, but are nevertheless of different width; and in the case of the relatively wide lamination stack, at least two partial lamination stacks are separated from one another by said cooling channel or one of said cooling channels.

9. The core according to claim 1, wherein:

the core, as viewed from an inside to an outside, alternately has a lamination stack of a first kind and a lamination stack of a second kind;

in said lamination stack of the first kind, at least two partial lamination stacks are separated from one another by a gap forming said cooling channel; and in said lamination stack of the second kind, at least two partial lamination stacks lie on one another without a gap.

10. The core according to claim 9, wherein:

in said lamination stack of the first kind, all of said partial lamination stacks are separated from one another by a gap; and in said lamination stack of the second kind, all of said partial lamination stacks lie on one another without a gap.

11. The core as claimed in claim 9, wherein at least two said lamination stacks of the first and second kind which lie on one another have an equal number of partial lamination stacks of identical width.

12. The core according to claim 1, wherein:

said laminations are formed by a thin-walled strip material; and each of said lamination stacks is wound from said strip material.

13. The core according to claim 12, wherein said thin-walled strip material is an amorphous strip material.

14. The core according to claim 1, which further comprises at least one additional cooling channel having a longitudinal direction extending parallel to the layer plane of said laminated sheets.

15. The core according to claim 1, wherein:

said lamination stacks are bent in sections with a given bending radius, and wherein the bending radii of at least two said lamination stacks that lie on one another are selected so as to form a hollow space, in a bending region between said at least two lamination stacks;

wherein said hollow space is connected to one of said cooling channels or all of said cooling channels and is configured to enable makes it possible for a coolant to be fed into the cooling channel or cooling channels through the hollow space.

16. The core according to claim 15, wherein said hollow space is an arcuate gap.

17. The core according to claim 1, wherein said partial lamination stacks comprise a widest partial lamination stack and a narrowest partial lamination stack, and wherein a width of the widest partial lamination stack is an integer multiple of the narrowest partial lamination stack.

18. The core according to claim 1, wherein:

wherein said partial lamination stacks are wound and stabilized and fixed by tensioning belts;

wherein said tensioning belts are arranged on said lamination stacks such that a position of said tensioning belts is respectively offset in relation to said tensioning belt of an adjacent said partial lamination stack and said tensioning belts are configured to form a cooling channel in a space between said partial lamination stacks.

* * * * *